US005763823A

United States Patent [19]

Siekierka et al.

[11] Patent Number: 5,763,823

[45] Date of Patent: Jun. 9, 1998

[54] PATCH CABLE FOR HIGH-SPEED LAN APPLICATIONS

[75] Inventors: Thomas J. Siekierka, Richmond, Ind.; Paul Z. Vanderlaan, Oxford, Ohio

[73] Assignee: Belden Wire & Cable Company, Richmond, Ind.

[21] Appl. No.: 585,704

[22] Filed: Jan. 12, 1996

[51] Int. Cl.[6] ..... H01B 11/04

[52] U.S. Cl. ..... 174/27; 174/113 R

[58] Field of Search ..... 174/27, 113 R, 174/121 A

[56] References Cited

U.S. PATENT DOCUMENTS

| | | | |
|---|---|---|---|
| 4,274,895 | 6/1981 | Bascou et al. | 156/53 |
| 4,823,095 | 4/1989 | Atallah et al. | 333/22 R |
| 4,873,393 | 10/1989 | Friesen et al. | 174/36 |
| 5,209,987 | 5/1993 | Penneck et al. | 428/610 |
| 5,593,317 | 1/1997 | Humbles | 439/502 |
| 5,597,981 | 1/1997 | Hinoshita et al. | 174/110 R |

*Primary Examiner*—Kristine L. Kincaid
*Assistant Examiner*—Marc D. Machtinger
*Attorney, Agent, or Firm*—Laff, Whitesel, Conte & Saret, Ltd.

[57] ABSTRACT

A patch high-speed cable for LAN applications having a jacket surrounding at least two twisted-pair insulated cables. Each of the twisted-pair cables have at least one tin sealed stranded tinned metal conductor. The tin sealed stranded tinned metal conductor has 7 or 19 tinned metal strands and a size of 24 or 26 AWG. Each of the tinned metal strands has a tin coating of 20 to 90 micro-inches. The insulation on the metal conductor has a thickness of about 0.007 to about 0.011 inches and a dielectric constant of about 2.2–2.5 and a dissipation factor of 0.0001 to 0.001. The twisted pair cable has an attenuation dB/100 ft. increase of less than 1.0 and preferably less than 0.5 when subjected, as an unterminated twisted pair cable over a 35 day period, to 100 MHz per 100 ft. and ambient air having a humidity of 40 to 80%.

11 Claims, 2 Drawing Sheets

PATCH CABLE FOR HIGH-SPEED LAN APPLICATIONS

FIELD OF THE INVENTION

This invention relates to stranded patch cables for high speed LAN applications. More particularly, the present invention relates to a LAN type cable having an insulated tin sealed seven or nineteen stranded tinned conductor.

BACKGROUND OF THE INVENTION

Tinned metal stranded patch cables for high-speed LAN applications are well known. However, the known cables, when subjected to environmental conditions and use over a period of time have an increase in attenuation. It is desirable to keep the increase in attenuation to a minimum. Except for our cable as hereinafter disclosed, we are not aware of any radio frequency—above 1 MHz—twisted pair cable with stranded conductor cable which would have an increase of less than 1.0 dB (decibels) per 100 ft. when first subjected to ambient air and 100 MHz for a period of 35 days.

SUMMARY OF THE INVENTION

It is therefore an aspect of the present invention to provide a metal stranded twisted pair cable for use with a frequency of greater than 1 MHz and having an attenuation that does not increase more than 1.0 dB/100 ft when first being exposed to ambient air and 100 MHz for 35 days.

Another aspect of the present invention is to provide a patch cable for high speed LAN application that has an insulated conductor with 7 or 19 tinned metal strands wherein each metal strand is tin-to-tin sealed to an adjacent strand and the tin coating on each strand is from about 20 to about 90 micro inches and the insulation has a dielectric constant of between about 2.2 to about 2.5 with a dissipation factor of about 0.0001 to about 0.001.

Other aspects of the invention will become apparent from the following detailed description taken in conjunction with the drawings.

DETAILED DESCRIPTION

Figure 1:
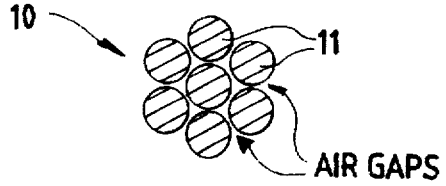
FIG. 1 PRIOR ART
FIG. 1 is a front view of the standard seven stranded electroplated tinned copper and conductor.
Figure 2:
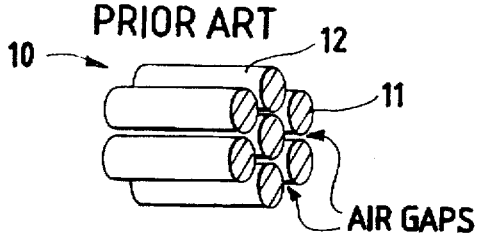
FIG. 2 PRIOR ART
FIG. 2 is a perspective view of standard seven stranded electroplated tinned copper conductor.

FIGS. 1 and 2 show the typical seven (7) strand tinned copper conductor 10 used in high speed cables for LAN applications. The stranded conductors are generally used because stranded conductors generally provide a longer flexlife than solid conductors. The reference standard generally used for tin coated wire is ASTM B33—94.

The conductor 10 has individual metal strands 11 which have an electroplated tin coating 12 thereon. The metal strands may be any suitable metal but are preferably copper The typical seven stranded electroplated tinned conductor 10 has a plurality of air gaps between the various strands 11. A 19 strand conductor is also utilized in high speed cable.

The term "high speed" as used throughout our specification and claims refer to cables used to transmit radio frequencies in excess of 1 MHz.

When using commercial high speed stranded twisted pair tinned copper cable, we discovered that when subjected to the environment that the attenuation decibel level increased.

Figure 3:
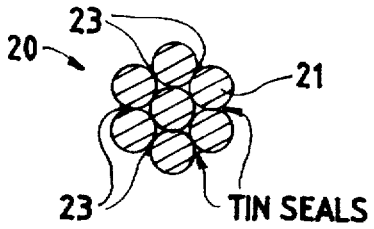
FIG. 3 is a front view of a tin sealed seven stranded electroplated tinned copper conductor used in the present invention.
Figure 4:
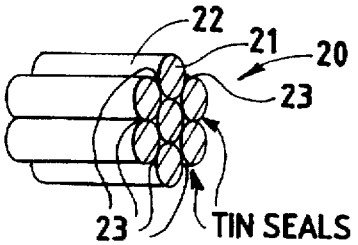
FIG. 4 is a perspective view of the tin sealed seven stranded electroplated tinned copper conductor of FIG. 3.

Referring to FIG. 3 and 4, there is shown a conductor 20 having seven metal, e.g. copper strands 21 which have a tin surface 22. The tinned copper strands 21 are tin sealed 23 to each other as shown in FIGS. 3 and 4. It is understood that the tin seal is prepared by heat treating a tinned stranded conductor so that the tin coating on each of the strands softens and blends with the tin coating on adjacent strands and an intimate tin bond or seal 23 is formed between adjacent tinned copper strands. The tin bonded or sealed tinned copper conductors used for our invention were purchased from Camden Wire Co., Inc. under their trademark PREBOND tinned copper conductors.

Figure 5:
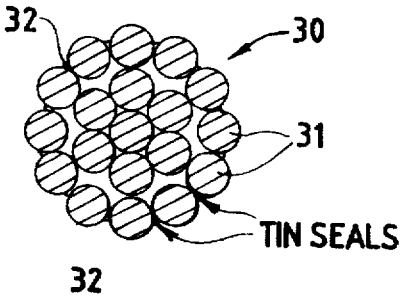
FIG. 5 is a front view of a tin sealed nineteen stranded electroplated tinned copper conductor used in the present invention.
Figure 6:
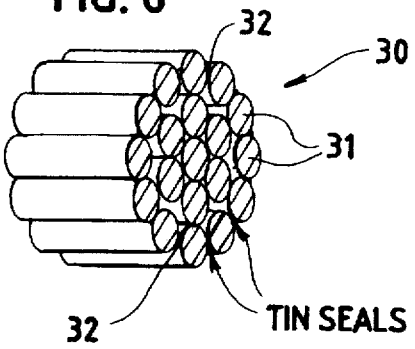
FIG. 6 is a perspective view of the tin sealed nineteen stranded electroplated tinned copper conductor of FIG. 5.

FIGS. 5 and 6 show a tin sealed stranded tinned copper conductor 30 having nineteen (19) tinned copper strands 31 which are tin bonded or sealed at 32.

The tin seal on the outer strands of the conductors tends to eliminate or substantially reduce the outer air gaps noted in the non-sealed conductors of FIGS. 1 and 2.

The tin sealed conductors 20 and 30 are then insulated with an appropriate dielectric such as polyethylene or polypropylene based insulations. The thickness of the insulation surrounding each conductor is from about 0.007 to about 0.011 inches and has a dielectric constant of about 2.2–2.5 with a dissipation factor of 0.0001 to 0.001.

The insulated conductors are paired and if desired, each pair of insulated conductors may be joined by an integral web there between. Each pair of insulated conductors is twisted to provide a twisted pair cable.

In some applications, in each twisted pair there may be one tin sealed stranded tinned metal conductor with the other conductor being a bare stranded (non-tinned) conductor or a non-tin sealed stranded conductor.

However, the most desirable twisted pair is where both conductors are tin sealed stranded tinned copper conductors.

Figure 7:
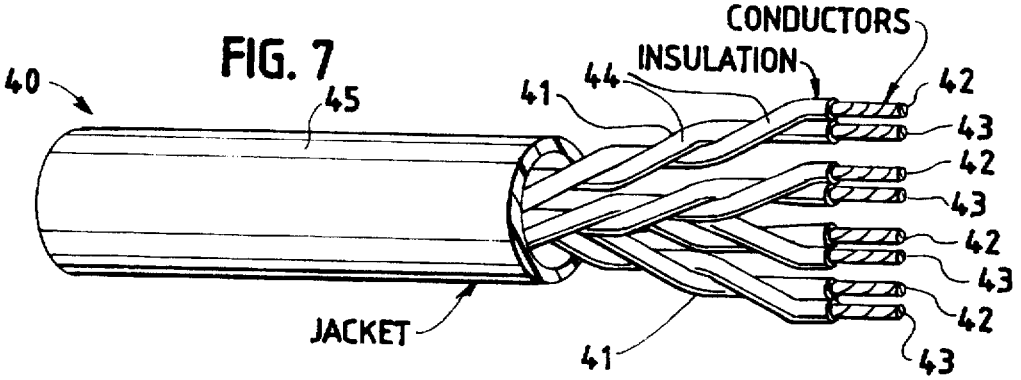
FIG. 7 is a perspective view of a high speed cable of the present invention.

FIG. 7 illustrates a cable of the present invention wherein there is a patch cable 40 for high speed LAN applications having four twisted-pair insulated conductors 41. Each twisted pair has at least one conductor 42 that is a tin sealed seven or nineteen strand tinned metal e.g., copper conductor. The other conductor 43 may be stranded bare metal or tinned metal, e.g. copper or stranded tinned metal conductor (not tin sealed). However, preferably, both of the conductors 42 and 43 in each pair are tin sealed stranded tinned copper conductors. The size of each stranded conductor 42 and 43 is 24 or 26 AWG and is insulated with insulation 44. The insulation 44 encases each of the conductors 42 and 43.

As stated above, the insulation has a thickness of about 0.007 to about 0.011 inches and a dielectric constant of about 2.2 to 2.5 and a dissipation factor of 0.0001 to 0.001.

The four twisted insulated conductor pairs 41 are enclosed and encased by an appropriate jacket 45 which surrounds and encapsulates the four twisted pairs 41. The jacket in this case is an appropriate polyvinyl chloride jacket or flame retardant polyolefin. However, the jacket may be any acceptable jacket material used for high-speed cables. The jacket has a thickness of about 0.015 to about 0.022 inches and a preferred thickness of 0.018 inches. The outer diameter of the cable 40 is about 0.185 inches to about 0.245 inches.

Our cable is intended to also cover cables wherein each twisted-pair or a group of twisted-pair or all of the twisted-pair conductors are shielded with an appropriate shield such as Belden Wire & Cable Company's BELDFOIL® shield.

We tested our high-speed twisted pair stranded cable against presently available twisted pair high-speed stranded cable.

We took 10 samples of twisted pair high speed seven stranded tinned copper insulated conductors from three different manufacturers. Each of the conductors were new and unterminated and were 100 ft. long. Each of the ten (10) twisted pairs were listed as having 24 AWG seven strand tinned copper conductors with a polypropylene insulation.

Ten 100 ft. samples of our unterminated twisted pair high-speed cables having 24 AWG tin sealed seven strand tinned copper conductors were a polypropylene insulation were compared to the three commercially available twisted pair cable.

Figure 8:
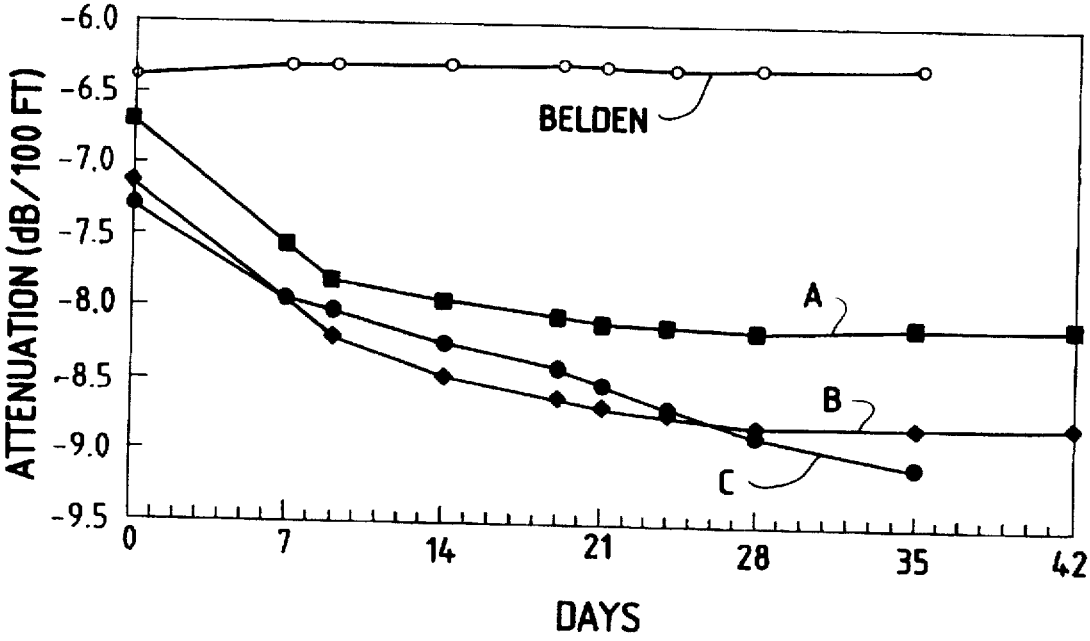
FIG. 8 is a graph illustrating the advantages of high speed twisted pair cables of the present invention over high speed twisted pair cables available.

Five previously unused or unterminated samples of our twisted pair cables and five unused or unterminated samples of each of the twisted pair cables A, B and C were subjected to ambient air having a humidity of 40 to 80% and an attenuation at 100 MHz was tested over a 35 to 42 day period with each twisted pair cable being tested the 1st, 7th, 9th, 14th, 19th, 21st, 24th, 28th and 35th day with only twisted pair cable B also being tested on the 42nd day. The average attenuation dB/100 ft. for the five samples of our twisted pair cable, the five samples of twisted pair cable A, the five samples of twisted pair cable B, and the five samples of twisted pair cable C are shown on the graph of FIG. 8. The average attenuation decibels (dB) per 100 ft. for our twisted pair cable over the entire 35 day test virtually did not increase or decrease and stayed within the 0.25 attenuation dB/100 ft. range for the entire 35 days—between–6.5 and—6.25 attenuation dB/100 ft.

The average attenuation dB/100 ft. of insulated conductor A increased from about-6.75 to –8.12 over a period of 42 days; and the average attenuation dB/100 ft of insulated conductor increased from about–7.12 to–8.6 over a period of 42 days; and the average attenuation dB/100 ft. of insulated conductor C increased from about–7.8 to–9.12 over a period of 35 days.

Our cable shows a marked improvement in attenuation when exposed to ambient air at 100 MHz.

Figure 9:
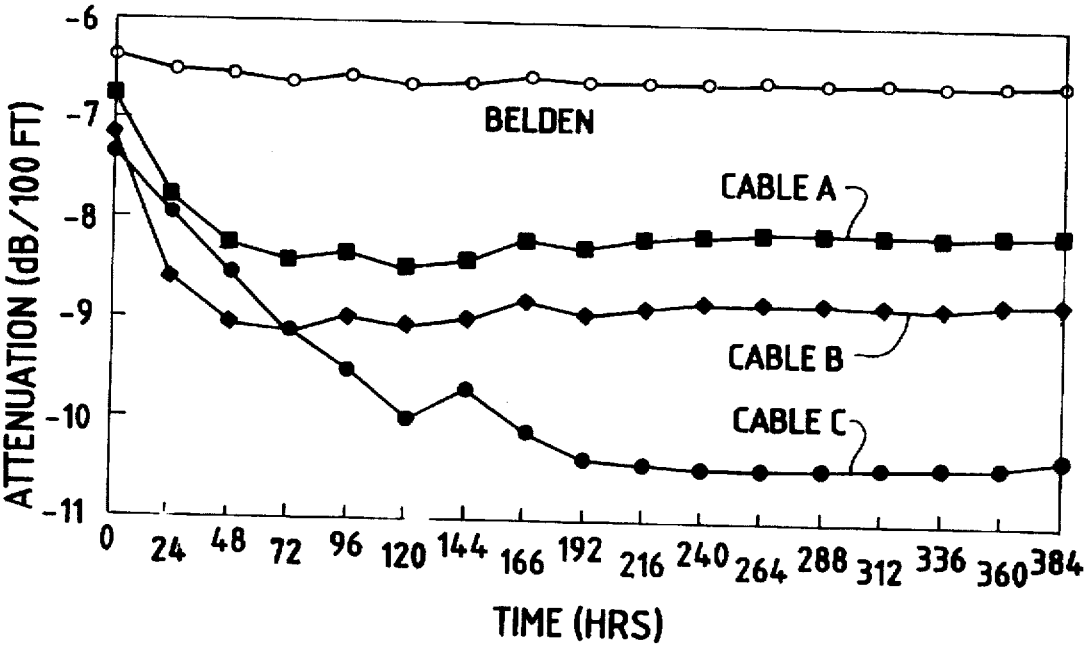
FIG. 9 is another graph illustrating the advantages of high speed twisted pair cables of the present invention over high speed twisted pair cables commercially available.

Five previously unused or unterminated samples of our insulated twisted pair cable and five unused or unterminated samples of each of the insulated twisted pair cables A, B and C were subjected to a humidified air condition having a humidity of 95 to 98% and their attenuation at 100 MHz was tested over a 384 hour period with each twisted pair cable being tested at the beginning and every twenty-four hours thereafter. The average attenuation dB/100 ft. for the five samples of our twisted pair cables, the five samples of twisted pair cable A, the five samples of twisted pair cable B, and the five samples of twisted pair cable C are shown on the graph of FIG. 9. The average attenuation decibels (dB) per 100 ft. of our twisted pair cable virtually did not increase or decrease and stayed within the 0.5 attenuation dB/100 ft. range for the entire 384 hours–between–6.4 and–6.6 attenuation dB/100ft.

The average attenuation dB/100 ft. of twisted pair cable A increased from about–6.75 to about–8.5; the average attenuation dB/100ft. of twisted pair cable B increased from about –7.12 to–9.1; and the average attenuation dB/100 ft. of twisted pair cable C increased from about–7.4 to–0.4.

Our cable shows a marked improvement in attenuation when exposed to humidified air at 100 MHz.

Therefore, it should be recognized that while the invention has been described in relation to a preferred embodiment, those skilled in the art may develop a wide variation of structural details without departing from the principles of the invention. Therefore, the appended claims are to be construed to cover all equivalents falling within the true scope and spirit of the invention.

We claim:

1. A patch high-speed cable for LAN applications comprising:

a jacket surrounding at least two twisted-pair insulated cables, each of said twisted-pair cables having two metal conductors including at least one insulated tin sealed stranded tinned metal conductor, said at least one tin sealed stranded tinned metal conductor having 7 or 19 tinned metal strands, said at least one tin sealed stranded tinned metal conductor having a size of 24 or 26 AWG, each of said tinned metal strands having a tin coating of 20 to 90 micro-inches, insulation on said at least one tin sealed stranded tinned metal conductor having a thickness of about 0.007 to about 0.011 inches, and said insulation having a dielectric constant of about 2.2–2.5 and a dissipation factor of 0.0001 to 0.001.

2. The cable of claim 1 wherein said tinned metal strands are tinned copper strands.

3. The cable of claim 2 wherein each of said twisted-pair cables when first subjected to ambient air having a humidity of 40 to 80% and 100 MHz per 100 ft. has less than a 1.0 attenuation dB/100 ft increase over thirty five days and when first subjected to humidified air having a humidity of 95 to 98% and 100 MHz per 100 ft. has less than 1.0 dB/100 ft attenuation increase over 384 hours.

4. The cable of claim 3 wherein the jacket has a thickness of about 0.015 to about 0.022 inches.

5. The cable of claim 4 wherein each of said two metal conductors are tin sealed stranded tinned copper conductors.

6. A twisted pair cable for radio frequencies above 1 MHz comprising a pair of tin sealed 7 or 19 stranded tinned metal conductors.

7. The twisted pair cable of claim 6 wherein said conductors are insulated with an insulation having a thickness of about 0.007 to about 0.011 inches, and said insulation having a dielectric constant of about 2.2–2.5 and a dissipation factor of 0.0001 to 0.001.

8. The twisted pair cable of claim 7 wherein said stranded tinned metal conductors are composed of tinned copper strands.

9. The twisted pair cable of claim 8 wherein said twisted pair cable when first subjected to ambient air having a humidity of 40 to 80% and 100 MHz per 100 ft. has less than a 1.0 attenuation dB/100 ft increase over thirty five days and when first subjected to humidified conditions and 100 MHz per 100 ft has less than 1.0 attenuation dB/100 ft increase over 384 hours.

10. The twisted pair cable of claim 9 wherein said twisted pair cable when first subjected to ambient air having a humidity of 40 to 80% and 100 MHz per 100 ft. has less than 0.5 attenuation dB/100 ft. increase over a period of thirty five days.

11. A patch high-speed cable for LAN applications comprising:

a jacket surrounding at least two twisted-pair insulated cables, each of said twisted-pair cables having a plurality of metal conductors including at least one insulated tin sealed stranded tinned metal conductor, said at least one tin sealed stranded tinned metal conductor having 7 or 19 tinned metal strands, said at least one tin sealed stranded tinned metal conductor having a size of 24 or 26 AWG, each of said tinned metal strands having a tin coating of 20 to 90 micro-inches, insulation on said at least one tin sealed stranded tinned metal conductor having a thickness of about 0.007 to about 0.011 inches, and said insulation having a dielectric constant of about 2.2–2.5 and a dissipation factor of 0.0001 to 0.001 wherein said at least one tin sealed stranded metal conductor is first tin sealed and then covered with said insulation.

* * * * *

UNITED STATES PATENT AND TRADEMARK OFFICE

CERTIFICATE OF CORRECTION

PATENT NO. : 5,763,823
DATED : June 9, 1998
INVENTOR(S) : Thomas J. Siekierka and Paul Z. Vanderlaan It is certified that error appears in the above-indentified patent and that said Letters Patent is hereby corrected as shown below:

Column 4, Line 8, delete "0.4" and insert --10.4--

Signed and Sealed this

Twentieth Day of October, 1998

*Attest:*

BRUCE LEHMAN

*Attesting Officer*

*Commissioner of Patents and Trademarks*